US005466292A

United States Patent [19]

Kustermann

[11] Patent Number: 5,466,292

[45] Date of Patent: Nov. 14, 1995

[54] APPARATUS FOR COATING TRAVELING WEBS OF PAPER OR CARDBOARD

[75] Inventor: Martin Kustermann, Heidenheim, Germany

[73] Assignee: J.M Voith GmbH, Germany

[21] Appl. No.: 167,804

[22] PCT Filed: Apr. 10, 1993

[86] PCT No.: PCT/DE93/00329

§ 371 Date: Dec. 15, 1993

§ 102(e) Date: Dec. 15, 1993

[87] PCT Pub. No.: WO93/21385

PCT Pub. Date: Oct. 28, 1993

[30] Foreign Application Priority Data

Apr. 15, 1992 [DE] Germany ..... 42 12 611.8

[51] Int. Cl.[6] ..... B05C 1/14

[52] U.S. Cl. ..... 118/257; 118/209; 118/249

[58] Field of Search ..... 118/257, 209, 118/249, 106; 101/DIG. 48

[56] References Cited

U.S. PATENT DOCUMENTS

| | | | |
|---|---|---|---|
| 1,268,891 | 6/1918 | Stommel | 118/257 |
| 1,818,911 | 8/1931 | Savy | 118/257 |
| 2,044,281 | 6/1936 | Clark et al. . | |
| 3,308,737 | 3/1967 | Fukuda | 118/257 |
| 4,006,052 | 2/1977 | Wang | 118/257 |
| 4,705,161 | 11/1987 | Gozdiff | 198/847 |

FOREIGN PATENT DOCUMENTS

| | | |
|---|---|---|
| 1425060 | 4/1969 | Germany . |
| 4100771 | 7/1991 | Germany . |

*Primary Examiner*—Karen M. Hastings
*Assistant Examiner*—Laura E. Edwards
*Attorney, Agent, or Firm*—Ostrolenk, Faber, Gerb & Soffen

[57] ABSTRACT

The invention relates to an applicator for the coating of a paper or the like web, having a belt which is guided around a support member and a drive roller and forming a nip with the web on a web guiding backing roll. A coating nip is formed between the backing roll and the belt for the application of the coating composition to the web. The support member for the belt at the nip is a roller of relatively small diameter, as compared with the guide roller. At least one further roller or a pair of such rollers support the small diameter roller.

23 Claims, 2 Drawing Sheets

APPARATUS FOR COATING TRAVELING WEBS OF PAPER OR CARDBOARD

BACKGROUND OF THE INVENTION

The present invention relates to an apparatus for coating a web of paper passing over a backing roll. The apparatus includes a belt which is guided around a support. The belt is driven to move coating composition from a supply thereof to a nip where the belt meets the web at the backing roll. The support supports the belt at the nip against the web to apply the coating composition there to the web. Such an apparatus is known from German Unexamined Application for Patent 4100771. By means of a support roller of relatively small diameter, coating is applied to the web by a belt which wraps around said roller in a nip which is formed along a backing roll which guides the web. In this connection, it is favorable, for the support roller to have a relatively small diameter in order, in this way, to guide the belt with a relatively small radius of curvature at and through the application nip. Of course, certain support structures are required for the support roller in order to be able to adjust the coating nip relatively precisely. The nip should have a width, for instance, of between 0.1 and 1.5 mm.

SUMMARY OF THE INVENTION

The object of the invention is to provide supporting devices for the support roller.

BRIEF DESCRIPTION OF THE DRAWINGS

This object is achieved in accordance with the invention wherein the support member comprises a roll of relatively small diameter as compared with the drive roll or the guide rolls for the belt. At least one further roll and perhaps two of them in turn support that supporting guide roll at the nip and provide more uniform force across the web at the nip. The invention will be explained below with reference to the embodiments shown in the figures of the drawing in which (in each case diagrammatically) there are shown.

DESCRIPTION OF PREFERRED EMBODIMENTS

Figure 1:
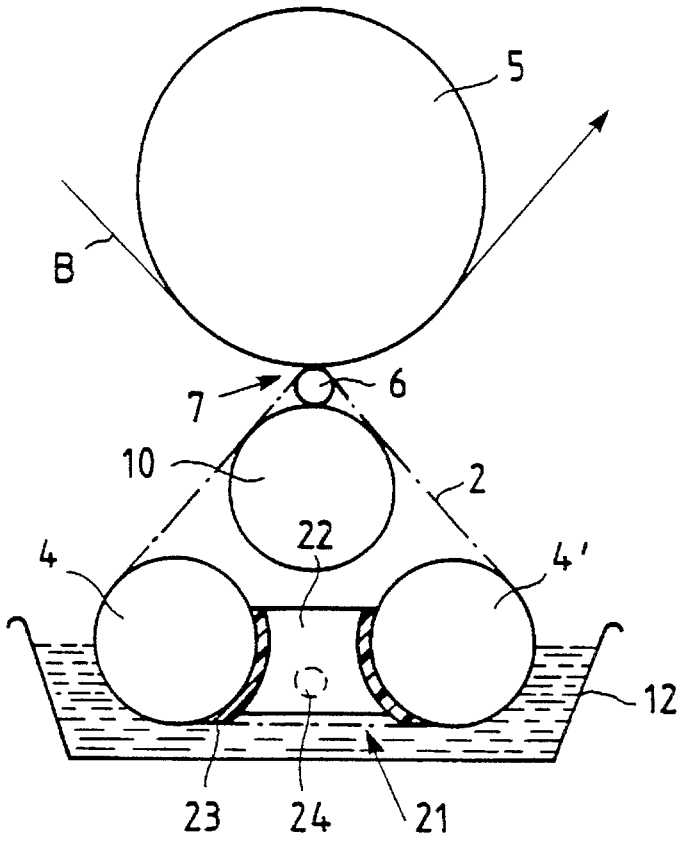
FIGS. 1 and 2, show two embodiments of a first basic development of the invention.

Referring to FIG. 1, the web of paper B is guided in the region of the applicator by a backing roll 5. The applicator has a flexible belt 2 of plastic, rubber or rubber-like plastic. The belt is guided over two guide rollers 4 and 4' which are arranged in such a position that their highest point is located above the level of a trough 12 which receives the coating composition. The belt 2 is further guided over a support roller 6 where the coating nip 7 with respect to the backing roll and traveling web is formed. The support roller 6 may advantageously have a diameter in the range of between 20 and 250 mm, and preferably between 40 and 150 mm. For the supporting of the support roller 6, there is provided supplemental support roller 10 having a diameter which is relatively large as compared with that of the support roller 6 and is within the region of the diameters of the guide rollers 4 and 4'. In this connection, at least one of the guide rollers is driven and serves to drive the belt 2 with the speed which it is to have in the coating nip. The speed of the web should preferably be more than 1000 m/min. The speed of the belt 2 should be adjustable and be between 5 and 100%, and preferably between 5 and 30%, of the speed of the web in case of the same direction of movement or between 5 and 30% of the speed of the web in case of the opposite direction of movement. The supplemental support roller 10, which supports the support roller 6, should also preferably be driven with a circumferential speed corresponding to the circumferential speed of the support roller (and therefore, in the event of the same diameter of the large rollers wrapped by the belt 2, with the drive speed of the driven guide roller 4).

Figure 2:
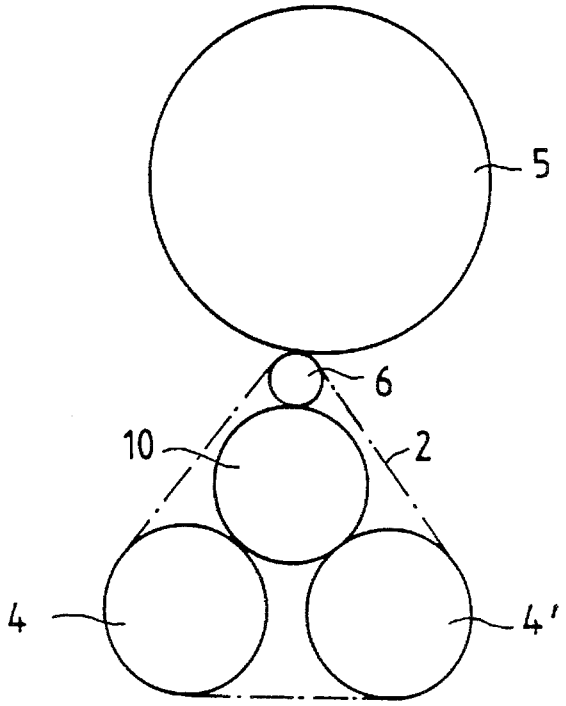

In accordance with FIG. 2, the supplemental support roller 10 is supported by the guide rollers 4 and 4'. In this case, of course, the supplemental support roller 10 can have a relatively small diameter since it is supported, in its turn, by the guide rollers. If, for example, in accordance with FIG. 1 the diameter of the supplemental support roller was between 300 and 500 mm, it can now be selected correspondingly smaller. The diameter of the support roller 6 can amount to between 10 and 150 mm, and preferably between 20 and 100 mm. The supplemental support roller 10 in the case of FIG. 1 can be offset somewhat in the direction of travel of the web with respect to the axis of symmetry of the axes of rotation of backing roll 5, support roller 6, and the two guide rollers in order to have an opposing force in horizontal direction for the hydrodynamic force upon the entrance of the belt and the web into the coating nip.

On the ends of the guide rollers 4 and 4' there are provided sealing devices 21 which are located in the region of the edges of the belt 2. These sealing devices consist, for instance, of a carrier 22 which is fastened via a mounting 24 to the end walls of the trough 12. On their edges facing the guide rollers and the belt 2 they have sealing ledges 23. The latter can consists of a very slidable plastic such as, for instance Teflon. Since it is to be expected that an absolute seal cannot be obtained, the space between the sealing devices 21, the guide rollers 4 and 4', and the lower part of the belt 2 are filled with water It is possible to achieve the result that only a very small amount of leakage water emerges, so that the consistency and composition of the coating composition is not substantially impaired.

Figure 3:
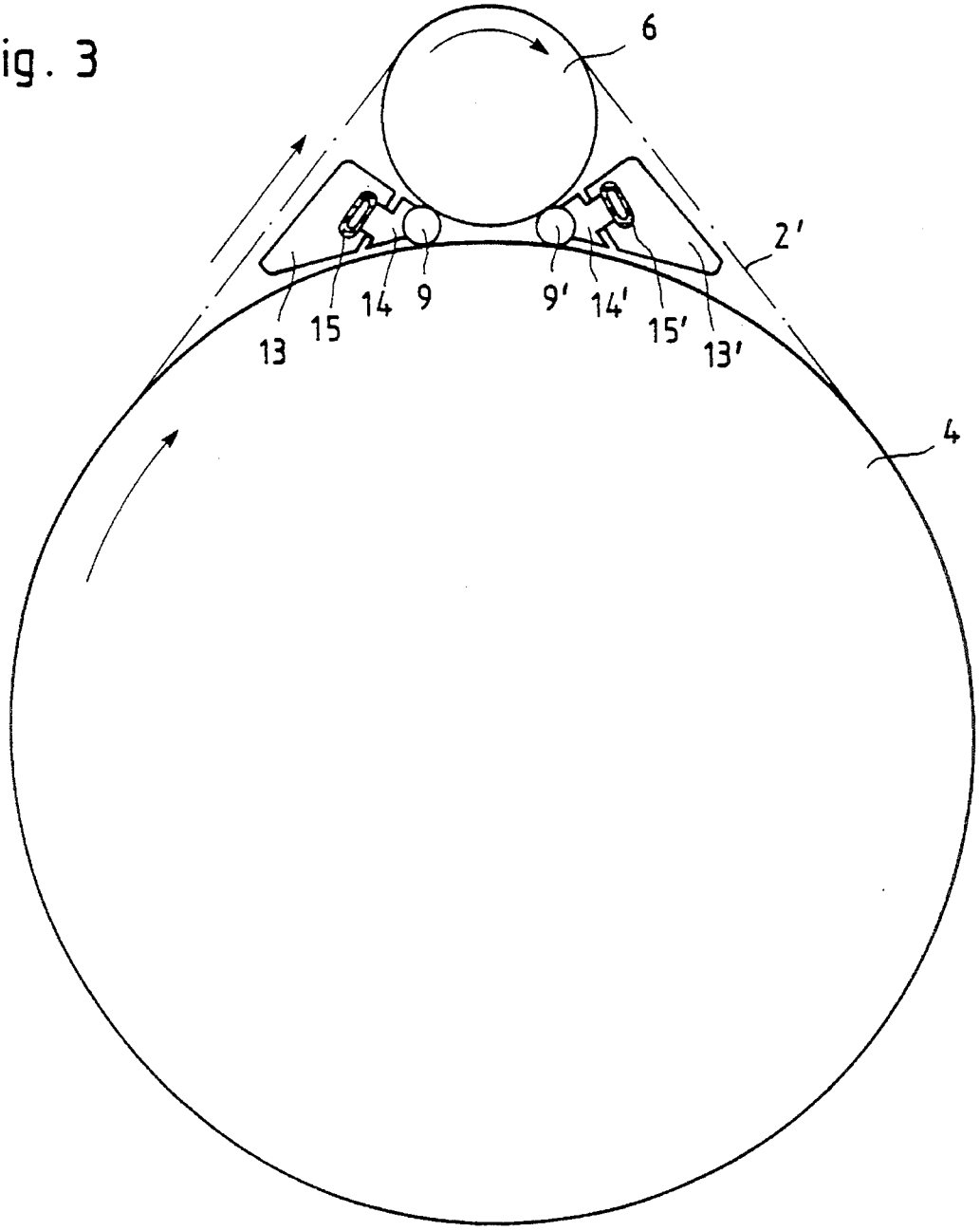
FIG. 3, a view of a second basic development of the invention.

In FIG. 3 only a single drive roller 4 is present, over which, as well as the support roller 6, the flexible belt 2' is guided. In this case, the trough which receives the coating composition and in which the drive roller 4 practically wades and the backing roll which guides the web are not shown. The support roller 6 is supported by additional support rollers 9, 9' of relatively small diameter on the guide roller 4. The rollers of relatively small diameter are, in each case, supported laterally by lateral carriers 13, 13' via ledges 14, 14' and pressure hoses 15, 15'. The two small additional support rollers have a diameter of about between 20 and 40 mm. They are, of course, also driven preferably with the circumferential speed of the support roller 6, as is the guide roller 4. By these small rollers, the result can be obtained that the support roller 6 is imparted a given curvature of its axis of rotation, which may also be equal to zero.

Figure 4:
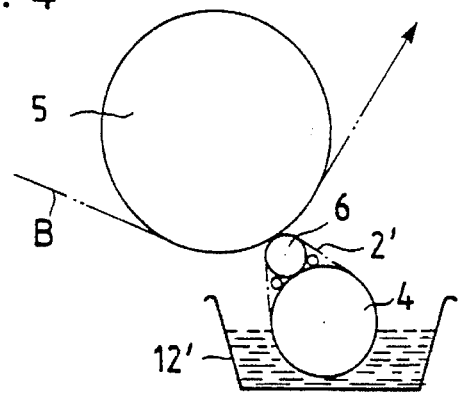
FIGS. 4 and 5, in each case, are variants of FIG. 3.

In FIG. 4, a variant of this embodiment is shown in which the plane of symmetry drawn through the axes of rotation of support roller 6 and drive roller 4 as well as between the two small rollers forms a certain angle of between 15° and 45° with the vertical so that the excess coating composition can easily run off at the application nip into the trough 12'.

Figure 5:
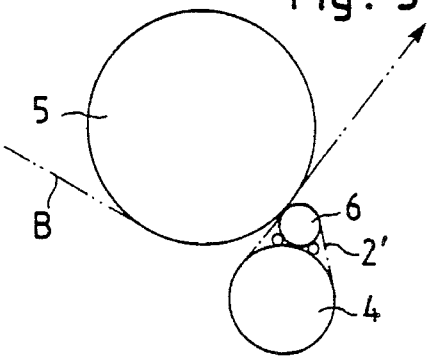

In accordance with FIG. 5, the plane of symmetry drawn through the axes of rotation of support roller 6 and drive roller 4 forms an angle of between 15° and 45° with the tangent to the backing roll 5 drawn in the coating nip. In this way, a preliminary dewatering and a distributing of the coating composition (ink) can be obtained which is advantageous particularly for intaglio printing papers.

It is not shown here that in the case of the variants of FIGS. 3 to 5 the small pair of rollers can also be omitted and the support roller 6 developed, for instance, in the manner of the known spreader roll in accordance with German Patent 1425060. This roll can have a plastic or rubber blanket.

The belt 2 can preferably consist of several layers, it being smooth and firm on the inside, for instance developed of a plastic or special steel, and having a felt-like fabric on the outside. In this way, the coating composition can be guided better and more uniformly to the coating nip.

I claim:

1. An applicator for coating a web of paper or cardboard, comprising:

a belt having an outer surface for carrying coating material from a supply of coating material to a web to be coated, and the belt outer surface cooperating with a web on a backing roll for applying the coating material to the web; the belt having an inner surface;

a drive roll engaging the inner surface of the belt for driving the belt to move past the web for delivering coating material to the web, the drive roll having a first diameter;

a support roll also engaging the inner surface of the belt and located at the web and opposed to the backing roll for supporting the belt to define a coating nip between the belt and the web at the backing roll; the support roll having a second diameter which is relatively smaller than the first diameter of the drive roll; and at least one supplemental support roll in contact with the support roll for supporting the support roll against the belt, the belt being thereby pressed against the web and the backing roll at the nip.

2. The applicator of claim 1, wherein the supplemental support roll for supporting the support roll is a single roll having a third diameter which is relatively larger than the second diameter of the support roll.

3. The applicator of claim 2, comprising two guide rolls for the inner surface of the belt and arranged symmetrically to the backing roll, to the support roll and to the supplemental support roll supporting the support roll; and at least one of the two guide rolls being the drive roll for the belt.

4. The applicator of claim 3, wherein the supplemental support roll and the two guide rolls are positioned so that the supplemental support roll rests on the two guide rolls; the drive roll is for rotating the supplemental support roll; and the support roll being in contact with the supplemental support roll for rotating the support roll.

5. The applicator of claim 1, wherein the support roll has a diameter in the range of between 20 and 250 mm.

6. The applicator of claim 1, wherein the support roll has a diameter in the range of between 40 and 150 mm.

7. The applicator of claim 1, wherein there is a single supplemental support roll.

8. The applicator of claim 1, wherein the belt has several layers including a smooth, firm layer on the inner surface toward the rolls and a felt fabric on the outer surface toward the web.

9. An applicator for coating a web of paper or cardboard, comprising:

a belt having an outer surface for carrying coating material from a supply of coating material to a web to be coated, and the belt outer surface cooperating with a web on a backing roll for applying the coating material to the web; the belt having an inner surface;

two guide rolls for the inner surface of the belt and arranged symmetrically to the backing roll, to the support roll and to the supplemental support roll supporting the support roll; and at least one of the two guide rolls being a drive roll engaging the inner surface of the belt for driving the belt to move past the web for delivering coating material to the web, the drive roll having a first diameter;

a support roll also engaging the inner surface of the belt and located at the web and opposed to the backing roll for supporting the belt to define a coating nip between the belt and the web at the backing roll; the support roll having a second diameter which is relatively smaller than the first diameter of the drive roll; and at least one supplemental support roll in contact with the support roll for supporting the support roll against the belt, the belt being thereby pressed against the web and the backing roll at the nip;

wherein the supplemental support roll for supporting the support roll is a single roll having a third diameter which is relatively larger than the second diameter of the support roll;

the guide rolls having opposite ends and the belt having opposite edges; and sealing devices located at the opposite ends of the guide rolls and in the regions of the opposite edges of the belt, the sealing devices having upper edges located above the level of the supply of coating material being supplied to the belt.

10. The applicator of claim 9, further comprising a trough in which coating material is to be supported, the sealing devices being in the trough and the upper edges of the sealing devices being located above the level of coating material in the trough.

11. The applicator of claim 9, wherein there are spaces between the sealing devices and the guide rolls for being filled with water.

12. An applicator for coating a web of paper or cardboard, comprising:

a belt having an outer surface for carrying coating material from a supply of coating material to a web to be coated, and the belt outer surface cooperating with a web on a backing roll for applying the coating material to the web; the belt having an inner surface;

a drive roll engaging the inner surface of the belt for driving the belt to move past the web for delivering coating material to the web, the drive roll having a first diameter;

a support roll also engaging the inner surface of the belt and located at the web and opposed to the backing roll for supporting the belt to define a coating nip between the belt and the web at the backing roll; the support roll having a second diameter which is relatively smaller than the first diameter of the drive roll; and two supplemental support rolls in contact with the support roll for supporting the support roll against the belt, the belt being thereby pressed against the web and the backing roll at the nip;

each of the supplemental support rolls being of a smaller diameter than the second diameter of the support roll; the supplemental support rolls being arranged symmetrically to a plane passing through axes of rotation of the backing roll and the support roll.

13. The applicator of claim 12, wherein the two supplemental support rolls and the drive roll are so placed that the supplemental support rolls rest on the drive roll, each of the supplemental support rolls is of smaller diameter than the first diameter of the drive roll; the supplemental support rolls resting with mirror symmetry with respect to the nip between the belt and the web at the backing roll.

14. The applicator of claim 13, wherein the supplemental support rolls are supported for adjustment laterally with respect to the support roll and the nip.

15. The applicator of claim 12, wherein the support roll has a diameter in the range of between 20 and 250 mm.

16. The applicator of claim 12, wherein there is a plane of symmetry through the axes of the support roll and the drive roll and extending between the two supplemental support rolls which is inclined with respect to a vertical axis.

17. The applicator of claim 16, wherein the plane of symmetry is inclined between 15° and 45° to the vertical axis.

18. The applicator of claim 12, wherein there is a plane of symmetry through the axes of rotation of the support roll and the drive roll, and extending between the two supplemental support rolls, which forms an inclined angle with a tangent to the backing roll in the nip.

19. The applicator of claim 18, wherein the angle at the tangent is between 15° and 45°.

20. The applicator of claim 12, wherein there is a plane of symmetry between the axis of the support roll and symmetrically between the supplemental support rolls which is inclined at an angle of 15° to 45° to a radius of the backing roll at the nip.

21. An applicator for coating a web of paper or cardboard, comprising:

a belt having an outer surface for carrying coating material from a supply of coating material to a web to be coated, and the belt outer surface cooperating with a web on a backing roll for applying the coating material to the web; the belt having an inner surface;

a drive roll engaging the inner surface of the belt for driving the belt to move past the web for delivering coating material to the web, the drive roll having a first diameter;

a support roll also engaging the inner surface of the belt and located at the web and opposed to the backing roll for supporting the belt to define a coating nip between the belt and the web at the backing roll; the support roll having a second diameter which is relatively smaller than the first diameter of the drive roll; and at least one supplemental support roll in contact with the support roll for supporting the support roll against the belt, the belt being thereby pressed against the web and the backing roll at the nip;

wherein there is a plane of symmetry through axes of the support roll and the drive roll and extending between a pair of supplemental support rolls which includes said at least one supplemental support roll, said plane of symmetry being inclined with respect to a vertical axis.

22. An applicator for coating a web of paper or cardboard, comprising:

a belt having an outer surface for carrying coating material from a supply of coating material to a web to be coated, and the belt outer surface cooperating with a web on a backing roll for applying the coating material to the web; the belt having an inner surface;

a drive roll engaging the inner surface of the belt for driving the belt to move past the web for delivering coating material to the web, the drive roll having a first diameter;

a support roll also engaging the inner surface of the belt and located at the web and opposed to the backing roll for supporting the belt to define a coating nip between the belt and the web at the backing roll; the support roll having a second diameter which is relatively smaller than the first diameter of the drive roll; and at least one supplemental support roll in contact with the support roll for supporting the support roll against the belt, the belt being thereby pressed against the web and the backing roll at the nip;

wherein there is a plane of symmetry through axes of the backing roll, the support roll and the drive roll which is inclined with respect to a vertical axis.

23. The applicator of claim 22, wherein the plane of symmetry is inclined between 15° and 45° with respect to the vertical axis.

* * * * *